United States Patent [19]

Paley et al.

[11] Patent Number: 4,888,229

[45] Date of Patent: Dec. 19, 1989

[54] WIPERS FOR CLEANROOM USE

[75] Inventors: Steven J. Paley, Aberdeen; Clifford A. Eberhardt; Edward Paley, both of Saddle Brook, all of N.J.

[73] Assignee: The Texwipe Company, Upper Saddle River, N.J.

[21] Appl. No.: 179,206

[22] Filed: Apr. 8, 1988

[51] Int. Cl.[4] ..... B32B 23/02

[52] U.S. Cl. ..... 428/192; 15/209 R; 428/193; 428/224; 428/246; 428/913

[58] Field of Search ..... 15/209 R; 428/192, 193, 428/246, 253, 913, 224

[56] References Cited

U.S. PATENT DOCUMENTS

| | | | |
|---|---|---|---|
| 2,319,307 | 7/1971 | Eddy | 428/193 |
| 2,414,424 | 1/1947 | Stevens | 428/193 |
| 3,316,117 | 4/1967 | Clifford et al. | 428/193 |
| 3,787,272 | 1/1974 | Nisbet et al. | 428/193 |
| 4,324,827 | 4/1982 | Obayashi et al. | 428/193 |
| 4,384,021 | 5/1983 | Aoyama | 428/193 |

*Primary Examiner*—James J. Bell

*Attorney, Agent, or Firm*—Samuelson & Jacob

[57] ABSTRACT

A method and a wiper for reducing particulate contamination which otherwise might result from the use of the wiper in a controlled environment, such as that maintained in a cleanroom, the wiper being of the type constructed at least partially from a thermoplastic fabric material by severing the wiper along peripheral edges thereof from a sheet of such material having indeterminate dimensions, the method and the wiper providing a fused border in the material along the peripheral edges of the wiper and extending inwardly into the wiper a distance great enough to provide the fused border with sufficient area and sufficient tear-strength to maintain therein segments of the material of the wiper which otherwise might be released from the peripheral edges of the wiper during use of the wiper, yet small enough to maintain pliability and absorbency in the wiper for wiping procedures. In one embodiment of the wiper, two outer plies of the material are joined along the fused border to establish a sealed envelope within which is placed an inner ply of absorbent material isolated from the controlled environment by the outer plies of material and the fused border.

11 Claims, 2 Drawing Sheets

WIPERS FOR CLEANROOM USE

The present invention relates generally to the prevention of particulate contamination in cleanrooms and pertains, more specifically, to the construction of wipers for use in a cleanroom, or another similar controlled environment, the construction being such that the wipers will not release contaminating particles into the controlled environment.

Cleanrooms are finding wider use in the manufacture, inspection and maintenance of precision products where it is essential that various operations be conducted in an environment as free of undesired small particles as possible. Cleanrooms can function effectively only when every effort is taken to maintain the close control necessary to preclude contamination of the controlled environment within the cleanroom. Such contamination most often is generated by the worker in the cleanroom and by items brought into the cleanroom. Rigorous standards have been established, and continue to be developed, for the operation of cleanrooms in such a manner as to exclude unwanted contaminants from the controlled environment. One potential source of particulate contamination in cleanrooms has been the wipers used extensively in connection with operations carried out in the controlled environment of a cleanroom. For example, in the fabrication of semiconductor wafers, wipers are used for cleaning up spills which can occur during the procedures carried out in the controlled environment of a cleanroom. In addition, wipers are used for wiping surfaces of various equipment and items in the cleanroom, as well as for wiping down the walls and other interior surfaces of the cleanroom itself. The very nature of a wiper, which requires a high degree of absorbency and pliability, militates against a construction which resists shedding and the concomitant release of small particles into the surrounding environment.

The present invention provides a wiper construction by which a potential source of particulate contamination of a cleanroom environment, or another such controlled environment, is eliminated in that particles which otherwise might be generated by a wiper used in the cleanroom, or other such controlled environment, no longer are present for release into the controlled environment. The invention attains several objects and advantages, some of which are summarized as follows: Eliminates a potential source of particulate contamination of a controlled environment, such as a cleanroom, by precluding the introduction of particles through the use of wipers in the environment; provides a wiper structure which eliminates the release of unwanted particles into a controlled environment, such as that found in a cleanroom, while enabling effective and efficient wiping procedures; enables the use of wiper materials having the desired pliability and absorbency characteristics in wipers employed in controlled environments, such as in cleanrooms, without risk of introducing particulate contamination into the controlled environment; promotes ease of use as well as effectiveness in wipers constructed for use in a controlled environment, such as a cleanroom; utilizes commonly available materials, thereby enabling economy of manufacture and use while eliminating a source of particulate contamination, as set forth above; provides a strong and durable as well as an aesthetically pleasing wiper which finds acceptance in a wide variety of manufacturing, inspection and maintenance procedures; and is readily manufactured economically in large numbers of consistent high quality.

The above objects and advantages, as well as further objects and advantages, are attained by the present invention, which may be described briefly as a wiper for reducing particulate contamination which otherwise might result from the use of the wiper in a controlled environment, such as that maintained in a cleanroom, the wiper being of the type constructed at least partially from a thermoplastic fabric material by severing the wiper along peripheral edges thereof from a sheet of such material having indeterminate dimensions, the wiper providing a fused border in the material along the peripheral edges of the wiper and extending inwardly into the wiper a distance great enough to provide the fused border with sufficient area and sufficient tear-strength to maintain therein segments of the material of the wiper which otherwise might be released from the peripheral edges of the wiper during use of the wiper, yet small enough to maintain pliability and absorbency in the wiper for wiping procedures. In one embodiment of the wiper, two plies of the material are joined along the fused border to establish a sealed envelope within which is placed an absorbent material isolated from the controlled environment by the plies of material and the fused border.

The invention will be understood more fully, while still further objects and advantages will become apparent, in the following detailed description of preferred embodiments of the invention illustrated in the accompanying drawing, in which.

Figure 1:
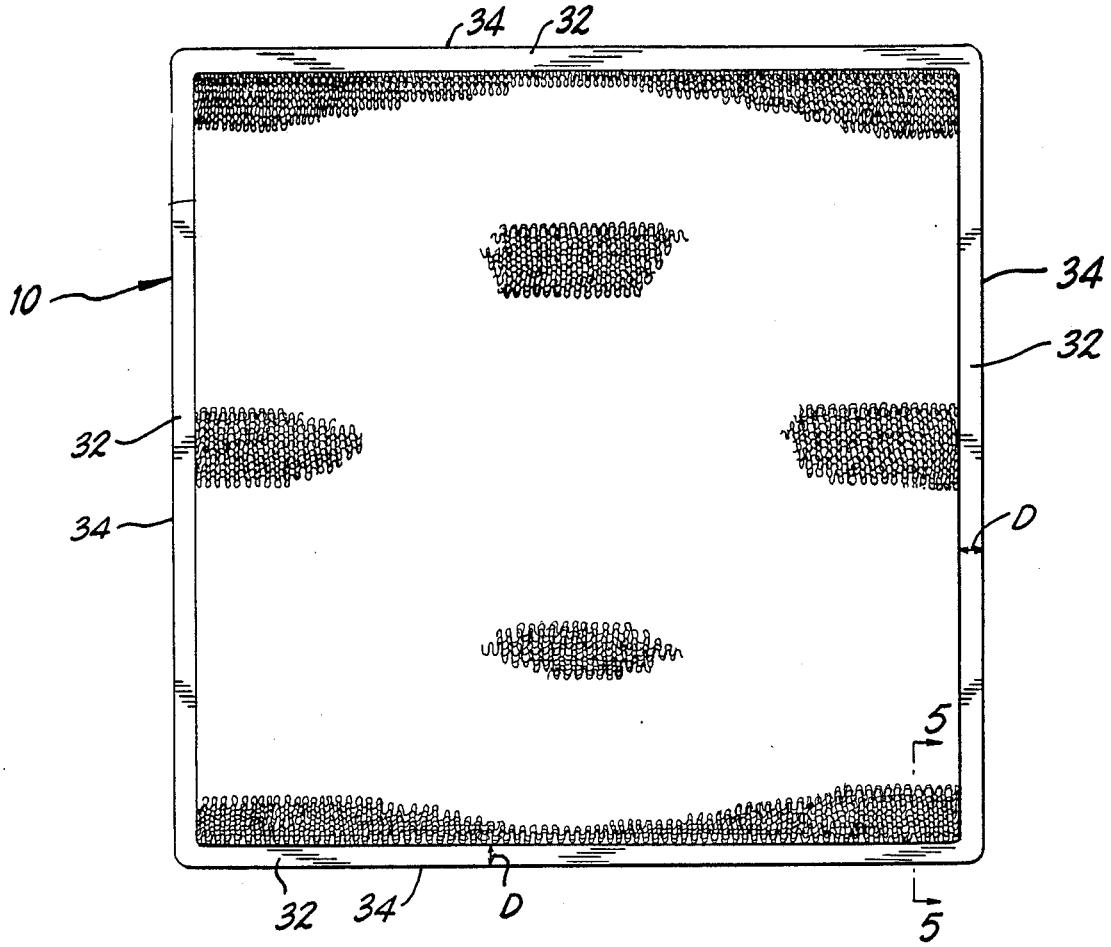
FIG. 1 is a plan view of a wiper constructed in accordance with the invention.
Figure 2:
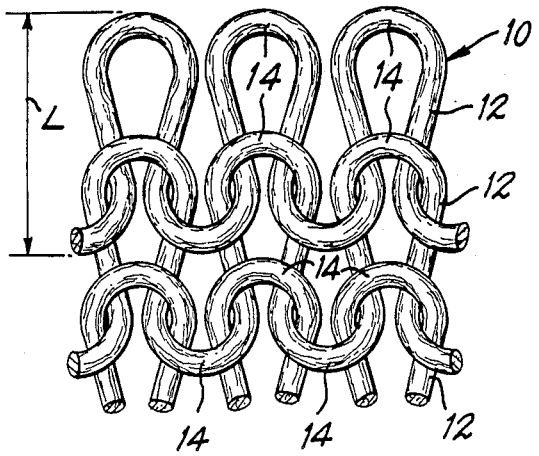
FIG. 2 is a somewhat diagrammatic, highly enlarged view of a portion of the material from which the wiper is constructed.

Referring now to the drawing, and especially to FIG. 1 thereof, a wiper constructed in accordance with the invention is illustrated generally at 10. Wiper 10 is constructed of one of a variety of generally thermoplastic fabric materials which have found use in wipers. Among these materials are polyester, nylon, polypropylene and blends of these materials, as well as blends of natural materials, such as cotton, with synthetic thermoplastic materials. The materials are in the form of a knitted, woven or non-woven fabric. The preferred material, and the one described in connection with the embodiment of wiper 10, is a knitted polyester, preferably knitted from a continuous filament. As illustrated in FIG. 2, the material of wiper 10 is constructed of filaments 12 knitted together in interlocking loops 14. The loops 14 have a relaxed loop length L. Preferably, the length L is very small, in the order of about 0.75 mm and the filaments 12, which are made up of a plurality of fibrils, have a diameter of about 0.25 mm, so that the wiper 10 is provided with the requisite pliability and absorbency.

Figure 3:
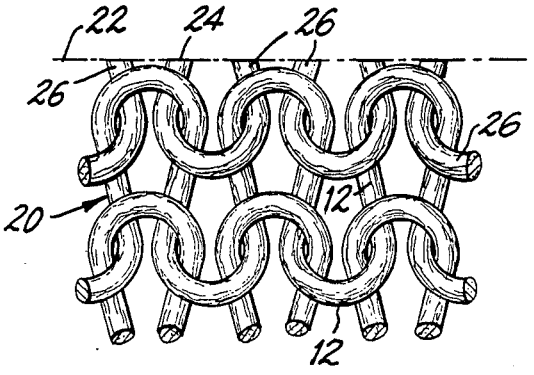
FIG. 3 is a view similar to FIG. 2, but illustrating a step in the procedure for constructing a wiper.
Figure 4:
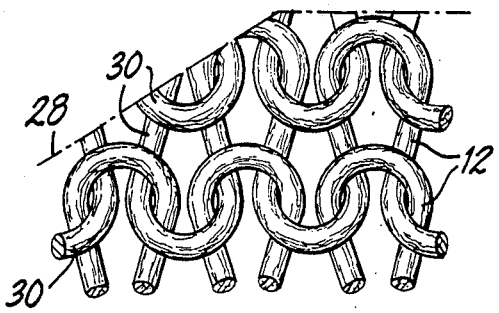
FIG. 4 is a view similar to FIG. 3, but showing an alternate configuration.

Wiper 10 is most economically manufactured by severing the wiper 10 from a larger sheet of the knitted fabric to establish a wiper of desired dimensions. However, as illustrated in FIG. 3, severing the fabric of a larger sheet 20 along a cut line 22 leaves a cut edge 24 along which there are free segments 26 of the filaments 12. These free segments 26 can be released into the ambient atmosphere and become contaminating particles when the wiper is utilized in a controlled environment, such as is found in a cleanroom. It has been suggested that cutting be accomplished with a hot knife or a hot wire so that the segments 26 will fuse and will remain in place within the remainder of the wiper; however, experience has shown that the localized melting of the segments 26 is insufficient to prevent the segments 26 from release when subjected to agitation and other manipulations common in the use of the wiper. Moreover, during the severing operation, the larger sheet 20 usually is stretched and distorted, particularly when the material is a knitted fabric, so that the interlocking loops of the material are somewhat skewed and the cut line is less uniform, as seen at 28 in FIG. 4. The less-uniform cut line 28 produces odd-shaped free segments 30, in addition to the aforesaid free segments 26, at locations which do not lend themselves readily to capture of all of the free segments 26 and 30 within the wiper, thereby increasing the propensity for contamination by the release of free segments into the surroundings.

Figure 5:
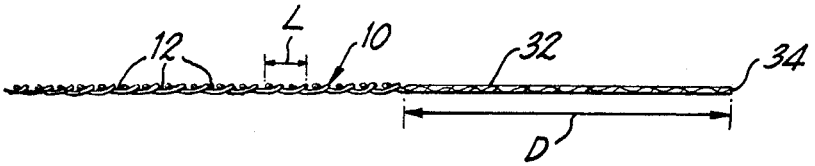
FIG. 5 is an enlarged cross-sectional view taken along line 5—5 of FIG. 1.

In order to preclude the release of severed segments from the remainder of the wiper, wiper 10 is provided with a fused border 32 along the peripheral edges 34 of the wiper 10, within which fused border 32 all of the severed segments are captured and retained throughout the useful service life of the wiper 10. As best seen in FIG. 5, as well as in FIG. 1, border 32 extends inwardly into the wiper 10, away from the peripheral edges 34, a distance D. The distance D is chosen so as to be large enough to accomplish the objective of capturing all of the segments 26 and 30 which otherwise could be free to escape into the ambient atmosphere and contaminate the controlled environment within which the wiper 10 is used, while resisting any tendency for tearing of the wiper 10 at the peripheral edges 34, yet is small enough to retain the desired degree of pliability in the wiper 10 and to resist any tendency toward abrasiveness in the wiper 10, while maintaining the necessary absorbency. In the illustrated wiper 10, the distance D is about 7L, that distance having been determined empirically as providing an optimum balance between attaining the complete capture of all of the otherwise free segments 26 and 30 along the peripheral edges 34 and establishing sufficient tear-strength, while maintaining pliability and resistance to abrasiveness. Thus, the selected distance D provides a border 32 of minimum area so as not to interfere with the requisite pliability and absorbency of wiper 10, while capturing potential contaminants in a construction having sufficient strength and durability to resist tearing and other deterioration during use. At the same time, abrasiveness is not introduced at the peripheral edges and an aesthetic appearance is maintained which provides a visual balance between the area of the border 32 and the area of the remaining absorbent portions of the wiper 10 to instill confidence in the user that the wiper 10 provides the necessary absorbency to accomplish any wiping job.

Figure 6:
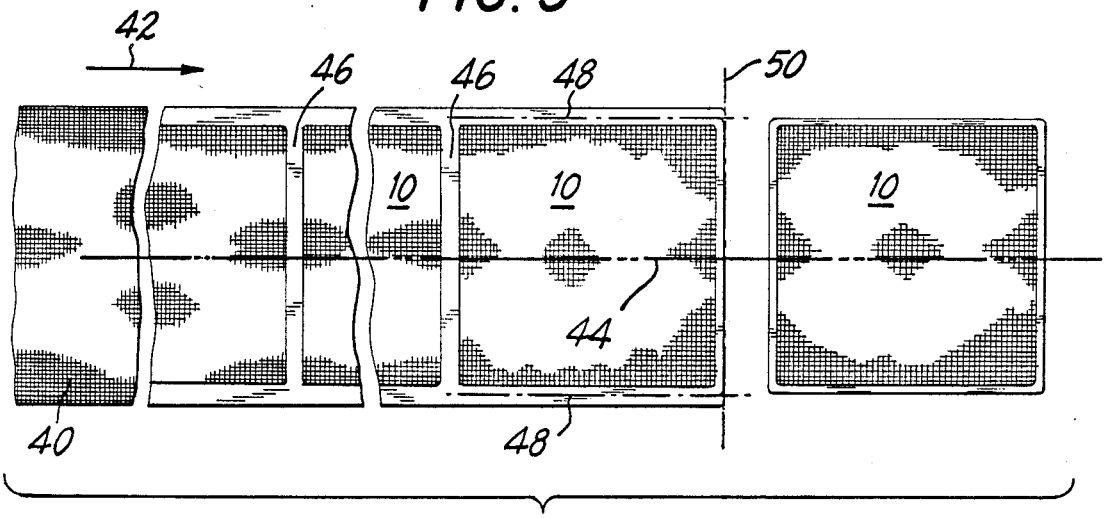
FIG. 6 is a partially diagrammatic view illustrating a procedure for the manufacture of the wiper.

Turning now to FIG. 6, the preferred manufacturing technique for making a plurality of wipers 10 is to sever the wipers from a sheet 40 of indeterminate dimensions. The sheet 40 is advanced in the direction of the arrow 42 along a predetermined path of travel 44. A pattern 46 is fused in the sheet 40, the pattern defining a plurality of latent wipers 10 including fused and unfused areas, and the sheet 40 is severed within the fused pattern 46, along sever lines 48 and 50, to establish each individual wiper 10 with a fused border 32 along the peripheral edges 34 of wiper 10. In this manner, dimensional stability is maintained for wiper manufacture, while the appropriate fused border 32 is established in each wiper 10.

Figure 7:
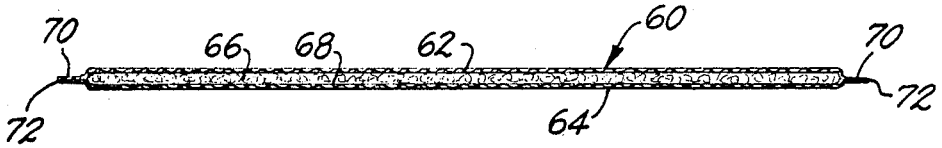
FIG. 7 is a longitudinal cross-sectional view of an alternate wiper construction of the present invention.

An alternate wiper construction is illustrated in FIG. 7 wherein a composite wiper 60 includes two sheets of material in the form of outer plies 62 and 64 of a thermoplastic fabric material, chosen from the materials outlined above in connection with the description of wiper 10, and a third sheet, or inner ply, in the form of pad 66 of highly absorbent material, such as cotton, a blend of polyester and cellulose, tissue stock or the like, sealed within the envelope 68 provided by the outer plies 62 and 64. A fused border 70 extends along the peripheral edges 72 of the wiper 60, all around the periphery of the wiper, in much the same manner as that described in connection with wiper 10. In this manner, the fused border 70 secures together the outer plies 62 and 64 and at the same time precludes the release of any segments of the thermoplastic fabric material which forms the plies 62 and 64, and together with the remainder of the plies 62 and 64 isolates the pad 66 so that any particles which might otherwise emanate from the material of the pad 66 are maintained within the wiper 60 and are precluded from contaminating the environment within which wiper 60 is employed. It is noted that even in those instances where pad 66 is in the form of a sheet which extends all the way to the peripheral edges 72, as a result of the particular manufacturing process in which the pad 66 and the plies 62 and 64 all have essentially the same length and width and are placed into juxtaposition with one another prior to establishing the fused border 70, the fused border 70 will preclude the emanation of particles from the pad 66, as well as from the outer plies 62 and 64, while securing together the plies 62 and 64 and the interposed pad 66. Thus, wiper 60 makes available the use of highly absorbent materials in pad 66, while assuring that potentially contaminating particles, which are prevalent in such absorbent materials, are contained and are not released to the controlled environment within which wipers 60 are to be used.

It is to be understood that the above detailed description of preferred embodiments of the invention are provided by way of example only. Various details of design, construction and procedure may be modified without departing from the true spirit and scope of the invention as set forth in the appended claims.

The embodiments of the invention in which an exclusive property or privilege is claimed are defined as follows:

1. In a wiper of the type constructed at least partially from a fabric material chosen from a woven material, a non-woven material or a knitted material, the fabric material including thermoplastic filaments, by severing the wiper along peripheral edges thereof from a sheet of such material having indeterminate dimensions, whereby the severing of the wiper from the sheet establishes segments of the filaments potentially freed for release from the wiper during use of the wiper, the potentially-freed segments having a maximum length, an improvement enabling the reduction of particulate contamination which otherwise might result from the use of the wiper in a controlled environment, such as that maintained in a cleanroom, the improvement comprising: a fused border in the material of the wiper along the peripheral edges of the wiper, the fused border extending inwardly into the wiper a distance so related to the maximum length of the potentially-freed segments of the filaments as to capture and maintain within the fused border those potentially-freed segments of the material of the wiper which otherwise might be released from the peripheral edges of the wiper during use of the wiper, while maintaining pliability and absorbency in the wiper for wiping procedures.

2. The invention of claim 1 wherein the filaments are knit into interlocking loops having a relaxed loop length L and the distance over which the fused border extends inwardly into the wiper is a multiple of the length L.

3. The invention of claim 2 wherein the distance is at least about 7L.

4. The invention of claim 3 wherein L is about 0.75 mm.

5. In a wiper severed from a sheet of indeterminate dimensions constructed of filaments of thermoplastic material, the filaments being knit into interlocking loops having a relaxed loop length L, an improvement for rendering the wiper capable of being used in a controlled environment, such as that maintained in a cleanroom, without releasing unwanted particles of the filaments which might otherwise be formed in the vicinity of the peripheral edges of the wiper as a result of severing the wiper from the sheet, the improvement comprising: a border in which the filaments are fused together, the border extending from the peripheral edges inwardly into the wiper a distance which is a multiple of the length L so as to provide the border with sufficient tear-strength while maintaining within the fused border all segments of the filaments which otherwise might be present as a result of severing along the peripheral edges, thereby precluding the release of severed segments into the controlled environment.

6. The invention of claim 5 wherein the distance is at least about 7L.

7. The invention of claim 6 wherein L is about 0.75 mm.

8. A wiper of the type constructed at least partially from a thermoplastic fabric material by severing the wiper along peripheral edges thereof from sheets of such material having indeterminate dimensions, the wiper enabling the reduction of particulate contamination which otherwise might result from the use of the wiper in a controlled environment, such as that maintained in a cleanroom, the wiper comprising:

first and second sheets of said material juxtaposed with one another;

a fused border in the material of the wiper along the peripheral edges of the wiper, the fused border extending inwardly into the wiper a distance great enough to provide the fused border with sufficient area and sufficient tear-strength to secure together the first and second sheets and maintain within the border segments of the material of the wiper which otherwise might be released from the peripheral edges of the wiper during use of the wiper, yet small enough to maintain pliability and absorbency in the wiper for wiping procedures;

an envelope between the first and second sheets, the envelope being sealed by the fused border; and an absorbent material placed within the envelope and isolated from the controlled environment by the first and second sheets and the fused border such that particles from the absorbent material in the envelope will remain sealed within the envelope.

9. The invention of claim 8 wherein the sheets of material include filaments knit into interlocking loops having a relaxed loop length L and the distance over which the fused border extends inwardly into the wiper is a multiple of the length L.

10. The invention of claim 9 wherein the distance is at least about 7L.

11. The invention of claim 10 wherein L is about 0.75 mm.

* * * * *

US004888229B1

REEXAMINATION CERTIFICATE (1719th)

United States Patent [19]

[11] B1 4,888,229

Paley et al.

[45] Certificate Issued Jun. 16, 1992

[54] WIPERS FOR CLEANROOM USE

[76] Inventors: Steven J. Paley, Aberdeen; Clifford A. Eberhardt; Edward Paley, both of Saddle Brook, all of N.J.

Reexamination Request:
No. 90/002,235, Dec. 19, 1990

Reexamination Certificate for:

| | |
|---|---|
| Patent No.: | **4,888,229** |
| Issued: | **Dec. 19, 1989** |
| Appl. No.: | **179,206** |
| Filed: | **Apr. 8, 1988** |

[51] Int. Cl.[5] ..... B32B 23/02

[52] U.S. Cl. ..... 428/192; 15/209 R; 66/170; 66/172 R; 428/193; 428/224; 428/246; 428/253; 428/913

[58] Field of Search ..... 428/192, 193, 224, 246

[56] References Cited

U.S. PATENT DOCUMENTS

| | | | |
|---|---|---|---|
| 1,773,967 | 8/1930 | Dreyfus . | |
| 2,093,425 | 9/1937 | Dreyfus | 156/88 |
| 2,319,307 | 5/1943 | Eddy | 117/4 |
| 2,327,468 | 8/1943 | Stocker | 164/65 |
| 2,414,424 | 1/1947 | Stevens | 66/172 |
| 2,535,029 | 12/1950 | Atanasoff et al. | 164/36 |
| 2,551,811 | 5/1951 | Mueller | 164/77 |
| 2,628,412 | 2/1953 | Vera | 28/72 |
| 3,076,252 | 2/1963 | Hofmann | 28/73 |
| 3,087,846 | 4/1963 | Soltis . | |
| 3,118,801 | 1/1964 | Lamport | 156/88 |
| 3,169,264 | 2/1965 | Walker | 15/118 |
| 3,316,117 | 4/1967 | Clifford et al. | 117/4 |
| 3,378,429 | 4/1968 | Obeda . | |
| 3,385,747 | 5/1968 | Klein et al. | 156/517 |
| 3,486,957 | 12/1969 | Fish et al. | 156/88 |
| 3,787,272 | 1/1974 | Nisbet et al. | 161/89 |
| 3,855,037 | 12/1974 | Imhagen et al. . | |
| 3,856,599 | 12/1974 | Bylund | 156/88 |
| 3,861,124 | 1/1975 | Bentzien . | |
| 3,863,826 | 2/1975 | Shoh | 228/1 |
| 3,873,859 | 3/1975 | Shoh | 310/8.1 |
| 3,939,033 | 2/1976 | Grgach et al. | 156/515 |
| 3,949,127 | 4/1976 | Ostermeier et al. | 428/137 |
| 3,966,519 | 6/1976 | Mitchell et al. | 156/73.1 |
| 3,989,579 | 11/1976 | Sheldon | 156/443 |
| 3,997,920 | 12/1976 | DeWoskin | 2/53 |

(List continued on next page.)

FOREIGN PATENT DOCUMENTS 0112654 7/1984 European Pat. Off. .

*Primary Examiner*—George F. Lesmes

[57] ABSTRACT

A method and a wiper for reducing particulate contamination which otherwise might result from the use of the wiper in a controlled environment, such as that maintained in a cleanroom, the wiper being of the type constructed at least partially from a thermoplastic fabric material by severing the wiper along peripheral edges thereof from a sheet of such material having indeterminate dimensions, the method and the wiper providing a fused border in the material along the peripheral edges of the wiper and extending inwardly into the wiper a distance great enough to provide the fused border with sufficient area and sufficient tear-strength to maintain therein segments of the material of the wiper which otherwise might be released from the peripheral edges of the wiper during use of the wiper, yet small enough to maintain pliability and absorbency in the wiper for wiping procedures. In one embodiment of the wiper, two outer plies of the material are joined along the fused border to establish a sealed envelope within which is placed an inner ply of absorbent material isolated from the controlled environment by the outer plies of material and the fused border.

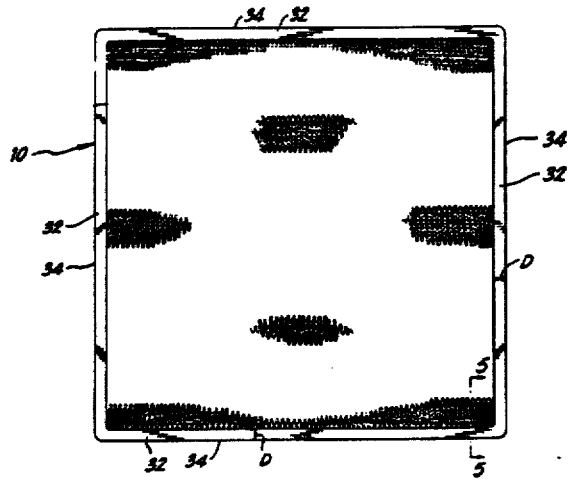

FIG. 1

U.S. PATENT DOCUMENTS

| | | | |
|---|---|---|---|
| 4,021,283 | 5/1977 | Weikert . | |
| 4,028,033 | 6/1977 | Bryant | 425/183 |
| 4,032,382 | 6/1977 | Obeda | 156/73.2 |
| 4,109,353 | 8/1978 | Mitchell et al. | 28/104 |
| 4,117,180 | 9/1978 | DeWoskin | 428/35 |
| 4,121,469 | 10/1978 | Kaule et al. | 73/643 |
| 4,144,109 | 3/1979 | Waligorski | 156/73.1 |
| 4,157,719 | 6/1979 | DeWoskin | 128/291 |
| 4,190,690 | 2/1980 | Rabeneck et al. | 428/35 |
| 4,265,842 | 5/1981 | Summo | 264/23 |
| 4,274,537 | 6/1981 | Cooper | 205/329 |
| 4,274,896 | 6/1981 | Bosse | 156/88 |
| 4,289,569 | 9/1981 | Rabeneck et al. | 156/580.2 |
| 4,290,547 | 9/1981 | Sullivan et al. | 229/77 |
| 4,305,988 | 12/1981 | Kocher | 428/158 |
| 4,308,010 | 12/1981 | DeWoskin | 433/5 |
| 4,313,774 | 2/1982 | Arthur | 156/73.1 |
| 4,313,778 | 2/1982 | Mims | 156/358 |
| 4,324,034 | 4/1982 | Berry et al. | 29/410 |
| 4,324,827 | 4/1982 | Obayashi et al. | 428/192 |
| 4,333,978 | 6/1982 | Kocher | 428/158 |
| 4,337,771 | 7/1962 | Pieniak et al. | 128/287 |
| 4,350,649 | 9/1982 | Summo | 264/23 |
| 4,355,425 | 10/1982 | Jones et al. | 2/402 |
| 4,361,230 | 11/1982 | Downing et al. | 206/345 |
| 4,363,992 | 12/1982 | Holze, Jr. | 310/323 |
| 4,384,021 | 5/1983 | Aoyama | 428/193 |
| 4,384,908 | 5/1983 | Kleist | 156/88 |
| 4,389,267 | 6/1983 | Denslow | 156/73.2 |
| 4,410,383 | 10/1983 | Lipari | 156/73.1 |
| 4,411,721 | 10/1983 | Wishart | 156/73.1 |
| 4,428,995 | 1/1984 | Yokono et al. | 428/193 |
| 4,442,939 | 4/1984 | Downing | 206/345 |
| 4,450,026 | 5/1984 | Pieniak et al. | 156/164 |
| 4,482,421 | 11/1984 | Gurak | 156/580.1 |
| 4,490,419 | 12/1984 | Sliva | 428/4 |
| 4,529,473 | 7/1985 | Mims | 156/580.2 |
| 4,534,818 | 8/1985 | Kreager et al. | 156/466 |
| 4,534,819 | 8/1985 | Payet et al. | 156/515 |
| 4,560,427 | 12/1985 | Flood | 156/73.3 |
| 4,592,118 | 6/1986 | DeWoskin | 24/444 |
| 4,594,955 | 6/1986 | Lichtenberg | 112/147 |
| 4,599,899 | 7/1986 | Jero et al. | 73/584 |
| 4,605,454 | 8/1986 | Sayovitz et al. | 156/73.1 |
| 4,606,079 | 8/1986 | DeWoskin | 2/338 |
| 4,610,750 | 9/1986 | Mango | 156/510 |
| 4,618,516 | 10/1986 | Sager | 428/35 |
| 4,623,420 | 11/1986 | Hinkley | 156/515 |
| 4,633,565 | 1/1987 | DeWoskin | 29/417 |
| 4,645,629 | 2/1987 | Stern | 264/23 |
| 4,651,043 | 3/1987 | Harris et al. | 310/323 |
| 4,653,362 | 3/1987 | Gerber . | |
| 4,668,316 | 5/1987 | Sager | 156/73.1 |
| 4,681,645 | 7/1987 | Fukushima et al. | 156/73.1 |
| 4,690,722 | 9/1987 | Flood | 156/510 |
| 4,693,771 | 9/1987 | Payet et al. | 156/73.3 |
| 4,711,693 | 12/1987 | Holze, Jr. | 156/580.1 |
| 4,713,130 | 12/1987 | Evans et al. | 156/72 |
| 4,713,267 | 12/1987 | Truskolaski | 428/4 |
| 4,755,242 | 7/1988 | Miller et al. | 156/88 |
| 4,769,095 | 9/1988 | Sager | 156/69 |
| 4,770,656 | 9/1988 | Proxmire et al. | 604/393 |
| 4,793,954 | 12/1988 | Lee et al. | 264/23 |
| 4,823,783 | 4/1989 | Willhite, Jr. et al. | 128/156 |
| 4,834,738 | 5/1989 | Kielpikowski et al. | 604/385.2 |
| 4,842,596 | 6/1989 | Kielpikowski et al. | 604/385.2 |
| 4,849,270 | 8/1989 | Evans et al. | 428/85 |
| 4,859,378 | 8/1989 | Wolcott | 264/23 |
| 4,931,114 | 6/1990 | Sliva | 156/73.1 |
| 4,935,081 | 6/1990 | Becking | 156/157 |
| 4,957,668 | 9/1990 | Plackard et al. | 264/23 |
| 4,959,895 | 10/1990 | Sager | 28/282 |

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2–4 and 6–11 are cancelled.

Claims 1 and 5 are determined to be patentable as amended.

New claim 12 is added and determined to be patentable.

1. In a wiper *for use in a controlled environment, such as that maintained in a cleanroom, wherein the wiper is* of the type constructed [at least partially] from a *knit* fabric material [chosen from a woven material, a non-woven material or a knitted material, the fabric material] including thermoplastic filaments[,]*; wherein the filaments of the fabric material are knit into loops having a relaxed loop length L in the order of about 0.75 mm.; wherein the wiper is formed* by severing the wiper along peripheral edges thereof from a sheet of such *knitted* material having indeterminate dimensions[, whereby]*; and wherein* the severing of the wiper from the sheet establishes *severed* segments of the *knitted* [filaments] *filament loops* potentially freed for release from the wiper during use of the wiper, the potentially-freed segments having a maximum length *equal to the relaxed loop length L*, an improvement enabling the reduction of particulate contamination *by the severed segments of the knitted filament loops* which [otherwise might result] *results* from the use of the wiper in a controlled environment, such as that maintained in a cleanroom, the improvement comprising:

a fused border in the material of the *cleanroom* wiper along *each of* the peripheral edges of the wiper *where the cleanroom wiper was severed from the knit material*, the fused border extending inwardly into the wiper a distance so related to the maximum length of the potentially-freed segments of the filaments as to capture and maintain within the fused border those potentially-freed segments of the material of the wiper which otherwise might be released *into the cleanroom* from the peripheral edges of the wiper during use of the wiper, while maintaining pliability and absorbency in the wiper for wiping procedures, *wherein the fused border extends inwardly into the wiper a distance of at least about 7L.*

5. In a wiper *for use in a controlled environment, such as that maintained in a cleanroom, wherein the wiper is* severed from a sheet of indeterminate dimensions constructed of filaments of thermoplastic material, the filaments being knit into interlocking loops having a relaxed loop length L *in the order of about 0.75 mm.*, an improvement for rendering the wiper capable of being used in a controlled environment, such as that maintained in a cleanroom, without releasing unwanted [particles] *severed segments* of the filaments [which might otherwise be] formed in the vicinity of the *severed* peripheral edges of the wiper [as a result of severing] *where* the wiper *was severed* from the sheet, the improvement comprising:

a border in which the filaments *at each of the peripheral edges where the cleanroom wiper was severed from the knit thermoplastic material* are fused together, the border extending from the peripheral edges inwardly into the wiper a distance which is a multiple of the length L so as to provide the border with sufficient tear-strength while maintaining within the fused border all *of said severed* segments of the filaments which [otherwise might be present as a] result [of] *from* severing along the peripheral edges, thereby precluding the release of severed segments into the controlled environment, *wherein the fused border extends inwardly into the wiper a distance of at least about 7L.*

*12. The invention of claim 1, wherein a plurality of said wipers are severed from the sheet of knit fabric material having a single ply.*

* * * * *